US010232435B2

(12) United States Patent
McKillen

(10) Patent No.: US 10,232,435 B2
(45) Date of Patent: Mar. 19, 2019

(54) REFRACTORY CERAMIC CASTING NOZZLE

(71) Applicants: REFRACTORY INTELLECTUAL PROPERTY GMBH & CO. KG, Vienna (AT); Gerard McKillen, Madison, OH (US)

(72) Inventor: Gerard McKillen, Madison, OH (US)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 178 days.

(21) Appl. No.: 15/127,123

(22) PCT Filed: May 5, 2014

(86) PCT No.: PCT/US2014/036836
§ 371 (c)(1),
(2) Date: Sep. 19, 2016

(87) PCT Pub. No.: WO2015/171114
PCT Pub. Date: Nov. 12, 2015

(65) Prior Publication Data

US 2017/0120325 A1 May 4, 2017

(51) Int. Cl.
*B22D 41/50* (2006.01)

(52) U.S. Cl.
CPC ..... *B22D 41/50* (2013.01)

(58) Field of Classification Search
CPC ..... B22D 41/50; B22D 41/54
USPC ..... 222/607
See application file for complete search history.

(56) References Cited

U.S. PATENT DOCUMENTS

| | | | | |
|---|---|---|---|---|
| 5,011,049 | A * | 4/1991 | Borom | B22D 41/50 222/590 |
| 2017/0120325 | A1* | 5/2017 | McKillen | B22D 41/50 |

FOREIGN PATENT DOCUMENTS

| | | |
|---|---|---|
| EP | 1878519 | 1/2008 |
| JP | H07256438 | 10/1995 |
| JP | 2000061619 | 2/2000 |

* cited by examiner

*Primary Examiner* — Scott R Kastler
(74) *Attorney, Agent, or Firm* — Medley, Behrens & Lewis, LLC

(57) ABSTRACT

The invention relates to a ceramic refractory casting nozzle for metallurgical applications. The term "nozzle" includes all types of substantially tube-shaped refractory parts which allow a metal melt flowing through a corresponding casting channel. This includes, i. a. a so-called submerged entry nozzle (SEN) and a so-called ladle shroud.

2 Claims, 2 Drawing Sheets

REFRACTORY CERAMIC CASTING NOZZLE

Figure 1:
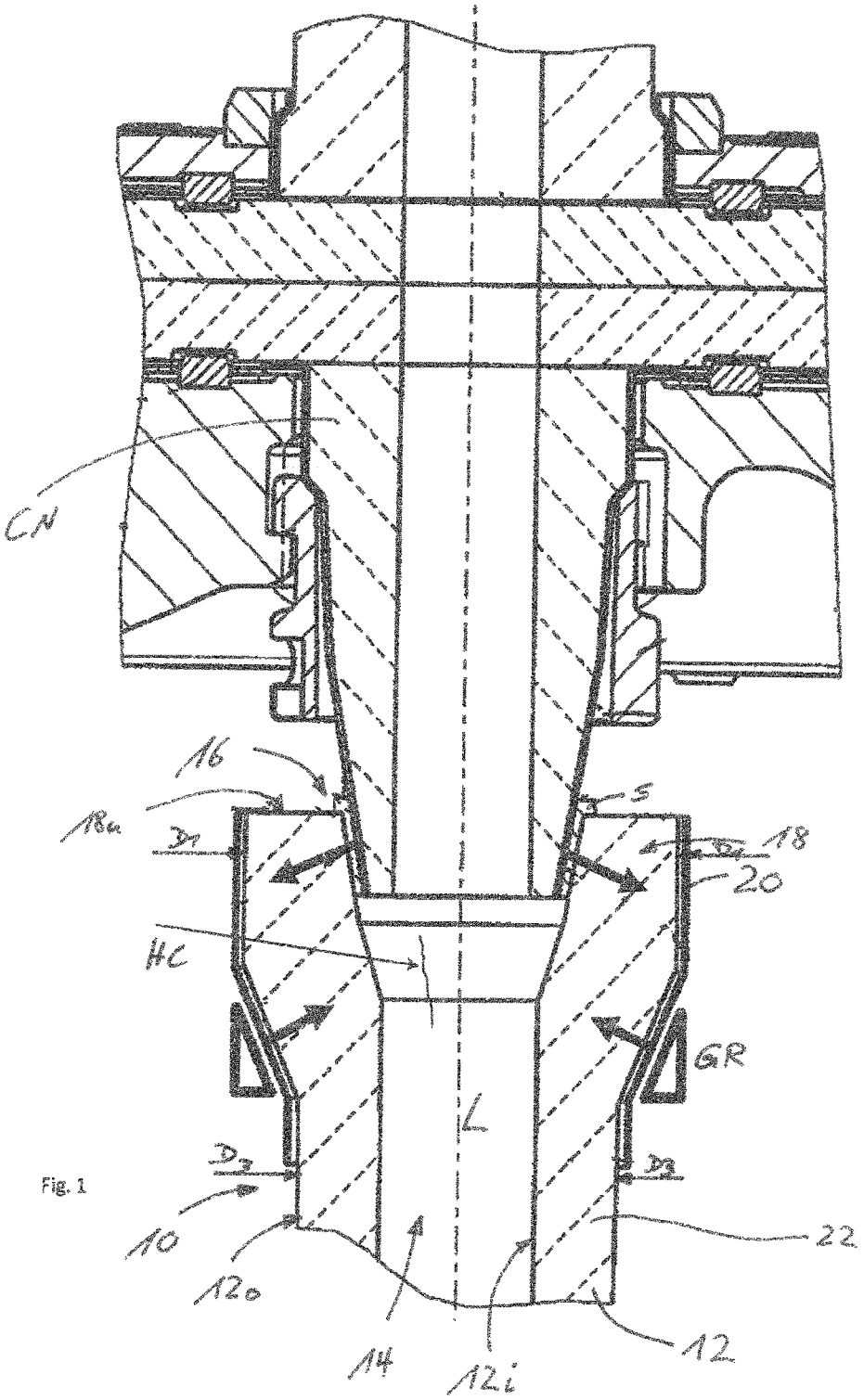

The invention relates to a ceramic refractory casting nozzle for metallurgical applications. The term "nozzle" includes all types of substantially tube-shaped refractory parts which allow a metal melt flowing through a corresponding casting channel. This includes, i. a., a so-called submerged entry nozzle (SEN) and a so-called ladle shroud (LS).

Refractory ceramic casting nozzles of this type often feature:

- a substantially tube-shaped refractory ceramic body with an inner nozzle surface and an outer peripheral nozzle surface,
- the inner nozzle surface surrounding a casting channel, which extends along an axial length of said nozzle between an inlet opening at a first nozzle end, being an upper end in a use position of the nozzle, and at least one outlet opening at a second nozzle end, being a lower end in the use position.

Prior art and the invention will be described hereinafter with respect to a ladle shroud notwithstanding further applications.

A known ladle shroud is characterized by a cylindrical upper (first) nozzle end, followed (towards the lower, second nozzle end) by a tapered section which then is followed by a further cylindrical section of smaller outer diameter than the upper cylindrical section. Such a design is also displayed in the attached Figures.

The tapered outer surface section serves as a bearing surface to arrange the shroud in a corresponding gimbal ring of a ladle shroud holder.

To avoid a direct contact between said gimbal ring and the outer (ceramic) peripheral nozzle surface it is further known to encapsulate the upper end of the nozzle, including said tapered section, by a corresponding metal can (metal envelope), which is either shrunk or mortared onto the outer peripheral nozzle surface.

Despite this "mechanical reinforcement" of the upper nozzle part the formation of cracks within the ceramic material could not be avoided. Such cracks, mostly vertical cracks (in the mounted position of the ladle shroud), often occur in a transition region between the cylindrical and tapered section as mentioned above.

It is therefore an object of the invention to provide means which avoid or at least which reduce crack formation in a generic casting nozzle.

During corresponding trials it has been observed that the steel in contact with the refractory (the metallic can in contact with the refractory body) heats up during metallurgical application and is subject to greater thermal expansion than the refractory ceramic body. At some point the metal expands to the point where it no longer holds the refractory in compression. This worsens the integral stability of the nozzle especially at the upper nozzle end and thus increases the danger of crack formation.

The invention accepts this phenomena but tries to countervail this effect by providing a material between the ceramic body and the metallic can which induces compression forces into the ceramic body when said nozzle undergoes thermal load.

While the different thermal expansion coefficients of metal and ceramic respectively may not be overcome at all the invention provides means which not only fill up the gap which is formed according to these different thermal behaviour between the corresponding surfaces of the metal can and the ceramic body but which further provides a mechanical compression onto and into the (often ring-shaped) upper nozzle end, into which a corresponding collector nozzle protrudes during metal casting. In other words: Mechanical compression forces are generated under thermal load between said outer metal casing (the envelope) and a corresponding adjacent surface section of the ceramic body.

This compression force may be provided by a material which expands under thermal load.

In its most general embodiment the invention relates to a ceramic refractory casting nozzle, featuring:

- a substantially tube-shaped refractory ceramic body with an inner nozzle surface and an outer (peripheral) nozzle surface,
- the inner nozzle surface surrounding a casting channel, which extends along an axial length of said nozzle between an inlet opening at a first nozzle end, being an upper end in a use position of the nozzle, and at least one outlet opening at a second nozzle end, being a lower end in the use position, wherein
- the outer peripheral nozzle surface of said first nozzle end is encapsulated with a metal casing, which extends over at least part of the axial length of the first nozzle end,
- a material, which expands under thermal load, is placed between said peripheral surface and said metal casing in such a way to allow compressive forces being induced into the ceramic refractory body.

The said material may be assembled between the refractory body and the said metal envelope in different ways.

Especially when applied to nozzles with a cylindrical profile at their upper end the invention provides and nozzle wherein the expandable material is assembled as one or more ring-like strips. In other words: The material may be assembled as a bandage, a belt or a ring applied to the cylindrical outer nozzle surface in a continuous shape.

The said strips may be applied directly onto the outer surface (for example glued onto the refractory material) and/or placed in corresponding ring-shaped recesses provided along the outer peripheral nozzle surface.

These embodiments allow to induce the said compression forces in an even and/or radial direction.

According to a further embodiment, the material is assembled at multiple discrete spots, arranged at a distance to each other along the peripheral nozzle surface. These "spots" may be discrete strips of arbitrary shape, for example strips, elongate in a vertical axial direction, and arranged at a distance to each other. Again these strips (spots) may be placed in corresponding recesses within the outer peripheral nozzle surface or directly fixed (for example glued) onto said surface.

To achieve constant compression forces it is advantageous to arrange the said spots at constant intervals.

According to further embodiments the material is based between said peripheral nozzle surface and said metal casing in such a way to allow compression forces of more than 0.1 $N/mm^2$ to be created onto and into the refractory ceramic body. To improve the described effects the said minimum compressive force can be increased at ≥0.2; ≥0.3; ≥0.6; ≥1.0; ≥2.0 or ≥3.0 $N/mm^2$, wherein the compression force is measured in accordance with the following protocol:

1. step, at room temperature (22° C.): a circular body (diameter: 19 mm, thickness: 5 mm) of said material is symmetrically arranged between two parallel plates of a pressure transducer
2. step: the experimental set-up (comprising transducer and body) is placed in a furnace and heated within 70 min to 300° C.

3. step: the pressure generated by said body onto said transducer plates is measured and registered.

The same test may be made up to 400° C. in step 2 with a compression force of at least 1.0 N/mm$^2$, at least 1.9N/mm$^2$, preferably ≥3N/mm$^2$, further preferred ≥5N/mm$^2$ being required.

These data consider that—due to the inevitable expansion of the metal can at a greater rate than the thermal expansion of the refractory material it surrounds—will create a gap that said material has to fill during expansion.

In order to achieve these effects the material must maintain the necessary pressure while still being free to fill any gap that is created in service as a result of the nozzle being heated up.

This effect may not only be achieved by placing the said material in different ways between can and refractory material by also by varying the respective amount of said material and/or by selecting a special material which allows to induce said forces under specific use conditions.

A suitable material is an intumescent composition.

The material can be an expandable graphite, and/or an expandable graphite with some intersticial water being removed prior to its assembly, and/or an inorganic expandable material such as expandable vermiculite and/or expandable perlite, both with or without binder.

Additives like non-expandable graphite, rubber, caoutchouc, mica and fluids may be added in respective amounts to adjust the requested intumescent properties.

Other materials, featuring the same or similar properties may be selected.

A specific intumescent material may be described as follows, all solid components in a grain fraction <1 mm:

22M.-% expandable graphite
20M.-% non-expandable graphite
9M.-% binder (novolac resin)
9M.-% water
16M.-% neoprene rubber
24M.-% Mica and provided by rolling to corresponding strips of suitable thickness and width, which may be used in the described way after drying at 30° C. for 3 hours.

As disclosed above the said expandable material may be applied over a certain axial length of the nozzle. This includes the following alternatives:

The material is applied over the whole contact surface between the can and refractory material.

The material is applied at least over a certain length downwardly from the upper nozzle end.

The material is applied between can and refractory material along the upper nozzle end.

The material is applied between can and refractory material along the upper nozzle end of constant diameter.

Further features of the invention will be described in the sub-claims and the other application documents.

The invention will now be described with respect to the attached drawing, showing—each in a schematic way—in FIG. 1: A vertical cross-section of an upper end of a ladle shroud in contact with a corresponding collector nozzle according to prior art.

Figure 2:
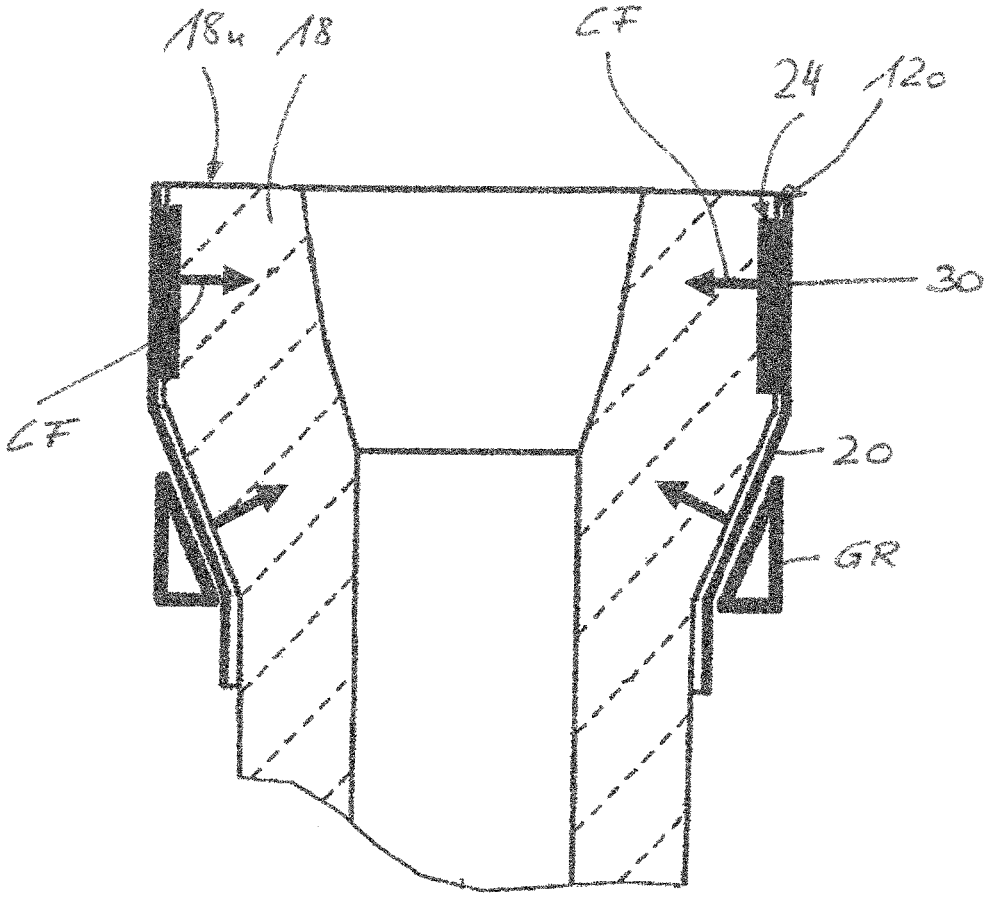

FIG. 2: The upper end of a ladle shroud according to the invention (in a vertical cross-sectional view).

In the Figures identical or similar parts are identified by the same numerals.

FIG. 1 displays a refractory ceramic casting nozzle, namely a ladle shroud 10, comprising the following features:

a substantially tube-shaped refractory ceramic body 12 with an inner nozzle surface 12*i* and an outer peripheral nozzle surface 12*o*, the inner nozzle surface surrounding a casting channel 14 which extends along an axial length L of said nozzle between an inlet opening 16 at a first nozzle end 18, being the upper end in the shown use position of the nozzle 10, and at least one outlet opening (not displayed) at a second nozzle end (not displayed), being a lower end of the nozzle in its use position, wherein the outer peripheral surface 12*o* of said first nozzle end 18 is encapsulated with a metal can/casing 20, which extends from the uppermost surface 18*u* of the first nozzle end 18 downwardly to intermediate section 22 of said nozzle of a smaller diameter $D_3$ compared with the outer diameter $D_1$ of said ring-shaped upper surface 18*u*.

As may be seen from FIG. 1 there is a tapered section between said cylindrical upper section (with said diameter $D_1$) and said section 22 with said diameter $D_3$, wherein said frusto-conical tapered section provides a corresponding bearing surface for a so-called gimbal ring GR of a ladle shroud holder (not displayed).

A collector nozzle CN protrudes with its lower end into the funnel-shaped inlet opening 16 of nozzle 10 with a ring-shaped seal S in between.

Forces induced by said collector CN into said shroud 10 and/or forces induced by said gimbal ring into said shroud 10 are symbolized by corresponding arrows in FIG. 1.

The new ladle shroud is displayed in FIG. 2 and characterized by a ring-shaped recess 24 along the outer peripheral surface 12*o* of the first nozzle end 18, wherein the said recess 24 is filled with a strip (bandage) of an expandable graphite material 30, i. e. an intumescent material, which expands at temperatures at 200° C., thereby inducing compression forces, symbolized by arrows CF into the adjacent refractory ceramic material at first nozzle end 18.

These compression forces are due to the thermal expansion of the graphite material within said recess 24, as the outer metal can 20 closes the said recess radially outwardly. Even under thermal load, when a certain gap is produced between said metal can 20 and the refractory material of first nozzle end 18, the expansion of the graphite material being still such that the compression forces CF will be uphold in the requested way, i. e. with compression forces larger than 0.6 N/mm$^2$ at a temperature of at least of 300° C.

These compression forces are able to compensate any undesired compression forces induced by a corresponding nozzle CN as displayed in FIG. 1.

As a consequence the creation of cracks, in particular vertical cracks, as displayed in FIG. 1 by HC, are either avoided or considerably reduced.

The invention claimed is:

1. Refractory ceramic casting nozzle (10) featuring:

1.1 a substantially tube shaped refractory ceramic body (12) with an inner nozzle surface (12*i*) and an outer peripheral nozzle surface (12*o*), 1.2 the inner nozzle surface (12*i*) surrounding a casting channel(14) which extends along an axial length (L) of said nozzle between an inlet opening (16) at a first nozzle end (18), being an upper end in a use position of the nozzle (10), and at least one outlet opening at a second nozzle end, being a lower end in the use position, wherein 1.3 the outer peripheral nozzle surface (12*o*) of said first nozzle end (18) is encapsulated with a metal casing (20), which extends over at elast part of the axial length (L) of the first nozzle end (18), 1.4 a material (30), made of an intumescent composition, which expands under thermal load, is assembled as one or more ring-like strips and placed in at least one corresponding ring-shaped recess (24) provided along the outer peripheral nozzle surface (12*o*) between said peripheral nozzle surface (12*o*) and said metal casing (20) in such a way to allow compressive forces of more than 0.1 $N/mm^2$ being induced into the refractory ceramic body (12).

2. Nozzle according to claim 1, wherein the material (30) comrpsies at least one material of the group comprising: expandable graphite, expandable graphite with some interstitial water being removed prior to its assembly, combinations of non-expandable and expandable graphite with or without additives, expandable inorganic material, expandable vermiculite with or without a binder, expandable perlite with or without a binder.

* * * * *